US009903107B1

(12) United States Patent
Albright

(10) Patent No.: US 9,903,107 B1
(45) Date of Patent: Feb. 27, 2018

(54) BEAM CONNECTOR

(71) Applicant: Linda K. Albright, Hawley, MA (US)

(72) Inventor: Linda K. Albright, Hawley, MA (US)

( * ) Notice: Subject to any disclaimer, the term of this patent is extended or adjusted under 35 U.S.C. 154(b) by 0 days.

(21) Appl. No.: 15/382,341

(22) Filed: Dec. 16, 2016

(51) Int. Cl.
*E04B 1/32* (2006.01)
*E04C 3/00* (2006.01)

(52) U.S. Cl.
CPC ..... *E04B 1/3211* (2013.01); *E04C 3/00* (2013.01); *E04B 2001/3235* (2013.01); *E04B 2001/3247* (2013.01)

(58) Field of Classification Search
CPC ..... E04B 2001/3247; E04B 2001/3235; E04B 7/10
USPC ..... 52/81.3
See application file for complete search history.

(56) References Cited

U.S. PATENT DOCUMENTS 4,009,543 A * 3/1977 Smrt ..... E04B 1/3211 52/222
4,611,441 A * 9/1986 Wickens ..... E04B 1/3211 52/81.4
4,729,197 A * 3/1988 Miller ..... E04B 1/3211 403/172
6,295,785 B1 * 10/2001 Herrmann ..... E04B 1/3211 52/639
2003/0226319 A1 * 12/2003 Richards ..... E04B 1/3211 52/80.1
2007/0125033 A1 * 6/2007 Stephan ..... E04B 1/32 52/655.1
2009/0056239 A1 * 3/2009 Wolfram ..... E04B 1/3211 52/81.3
2012/0180405 A1 * 7/2012 Drake ..... E04B 1/3211 52/81.3
2013/0152486 A1 * 6/2013 Hava ..... E04B 1/32 52/81.3
2016/0010322 A1 * 1/2016 Yonkers ..... E04B 1/3211 52/81.3

* cited by examiner

*Primary Examiner* — Beth A Stephan
(74) *Attorney, Agent, or Firm* — Lee Palmateer Law Office LLC; Lee Palmateer

(57) ABSTRACT

An improved beam connector providing enhanced means for connecting beams in geodesic spherical or domed dwellings and commercial structures. The improved connector design provides for construction of an entire geodesic frame using only one connector size and shape, and one beam size and shape. The improved connector comprises three angularly spaced apart legs radiating from the center at a downward pitch, each leg for receiving a beam. The top surfaces of each leg may form a dihedral angle for supporting adjacent exterior hexagonal and pentagonal panels. The bottom surfaces of each leg may form a dihedral angle for supporting adjacent interior hexagonal and pentagonal panels.

20 Claims, 22 Drawing Sheets

END VIEW PERPENDICULAR TO END OF LEG 10

END VIEW PERPENDICULAR TO END OF LEG 20

END VIEW PERPENDICULAR TO END OF LEG 30

BEAM CONNECTOR

TECHNICAL FIELD

The present invention relates to a structural apparatus for connecting beams.

BACKGROUND OF THE INVENTION

Domed structures provide certain advantages over other more traditionally shaped structures. Geodesic domes are one kind of domed structures. A geodesic dome is a portion of a geodesic sphere with a structural frame composed of a network of triangles wherein the vertices of the triangles are at points on the sphere and the sides of the triangles are along cords between the points. Geodesic domes may be simplified so that the vertices lie approximately on the sphere. The triangles create a self-bracing framework that gives structural strength while using a minimum of material. The design allows enclosure of large interior space, free from columns or other supports.

Geodesic sphere structures may comprise hubs and struts, wherein the struts are straight members that radiate from the hubs, and the hubs connect the struts together in a network of triangles. A single geodesic structure may comprise many different triangle patterns and varying triangle sizes. For example a three-frequency geodesic dome requires struts of three different lengths, 5-way hubs (connecting five struts) and 6-way hubs (connecting six struts). Unless otherwise indicated, the description herein will be based on a three-phase geodesic structure.

Five triangles share a vertex at a 5-way hub, and the triangle sides opposite the hub form a pentagon. Likewise, six triangles share a vertex at a 6-way hub, and the triangle sides opposite the hub form a hexagon. A three-phase geodesic sphere comprises a pattern of adjacent pentagons and hexagons having coincidental sides.

Struts are typically tubular construction and hubs are configured to receive the tubes, which results in a structure that has undesirable limitations with respect to supporting other components, such as exterior paneling, interior paneling, studs, insulation and utilities such as plumbing, wiring and HVAC.

Geodesic structures may also comprise wooden beams that have compound angles at their ends so that the ends of five or six beams mate together to form a snug hub joint, without a separate hub component. Such a joint is typically reinforced with additional construction materials such as metal straps and screws. This type of structure requires three different beam lengths with complex beam shapes. It also requires precision machining of complex, compound angles. Due to the various combinations of beam lengths and end shapes for different joints, construction can be very difficult and time consuming, requiring much care to provide the correct inventory of beams for a project, to select the right beams for each joint, to align the beams, and to assemble them into a joint.

There is a need for a beam connector that combines the benefits of a separate hub in a geodesic beam structure and simplifies the construction process, while providing a strong and easy to assemble joint.

The present invention is directed to an improved beam connector for connecting beams to form a geodesic structure. It provides a stronger joint and reduces material needs, manpower needs, and construction time. Due in part to the strength of the beam connector of the present invention, some of the beams in the geodesic pattern may be omitted from the structure. The remaining beams in the structure are disposed along the edges of adjacent hexagons and pentagons. Each beam connection comprises three beams instead of five or six. Therefore, the present invention provides even more material savings and even fewer beam joints to construct.

SUMMARY OF THE INVENTION

In a first aspect, the present invention provides a beam connector comprising a middle portion 41 (FIG. 1) and three legs extending radially outward from the middle portion at a downward longitudinal pitch of 11.64° from a horizontal plane, wherein the second leg is disposed at a 124.31° angle counterclockwise from the first leg, the third leg is disposed at a 111.38° angle counterclockwise from the second leg, and the first leg is disposed at a 124.31° angle counterclockwise from the third leg. The first leg comprises an upper portion adapted for receiving at least one object forming a dihedral angle of 138.19° along the longitudinal pitch line of said leg. The second leg comprises an upper portion adapted for receiving at least one object forming a dihedral angle of 142.62° along the longitudinal pitch line of said leg. And the third leg comprises an upper portion adapted for receiving at least one object forming a dihedral angle of 142.62° along the longitudinal pitch line of said leg.)

In a second aspect, the present invention provides a beam connector comprising a middle portion and three legs extending radially outward from the middle portion at a downward longitudinal pitch of 11.64° from a horizontal plane, wherein the second leg is disposed at a 124.31° angle counterclockwise from the first leg, the third leg is disposed at a 111.38° angle counterclockwise from the second leg, and the first leg is disposed at a 124.31° angle counterclockwise from the third leg, and wherein at least one of the first, second and third legs is adapted for connection to a beam disposed longitudinally along the pitch of the leg.

In a third aspect, the present invention provides a beam and connector assembly comprising: a beam connector comprising a middle portion and three legs extending radially outward from the middle portion at a downward longitudinal pitch of 11.64° from a horizontal plane wherein the second leg is disposed at a 124.31° angle counterclockwise from the first leg, the third leg is disposed at a 111.38° angle counterclockwise from the second leg, and the first leg is disposed at a 124.31° angle counterclockwise from the third leg; and a beam connected at one end to and disposed longitudinally along the pitch of one of the first, second and third legs.

In a fourth aspect, the present invention provides a beam and connector assembly comprising: a plurality of beam connectors, each beam connector comprising a middle portion and three legs extending radially outward from the middle portion at a downward longitudinal pitch of 11.64° from a horizontal plane wherein the second leg is disposed at a 124.31° angle counterclockwise from the first leg, the third leg is disposed at a 111.38° angle counterclockwise from the second leg, and the first leg is disposed at a 124.31° angle counterclockwise from the third leg; and a plurality of beams, each connected at one end to a leg of a beam connector and at the other end to a leg of another beam connector, wherein the on-center spacing between adjacently connected beam connectors is the same.

In a fifth aspect, the present invention provides a beam connector kit for connecting beams in a hexagonal and pentagonal pattern, comprising: at least one beam connector that comprises a middle portion; three legs extending radially outward from the middle portion at a downward longitudinal pitch of 11.64° from a horizontal plane, wherein the second leg is disposed at a 124.31° angle counterclockwise from the first leg, the third leg is disposed at a 111.38° angle counterclockwise from the second leg, and the first leg is disposed at a 124.31° angle counterclockwise from the third leg; and a plurality of beams having the same length for connecting to said beam connectors.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

FIGS. 1-10 show a preferred embodiment of the beam connector of the present invention. The description herein describes the preferred embodiment of FIGS. 1-10 unless otherwise indicated.

For the purposes of this description, references to the angle between two intersecting planes, or angle between two flat surfaces refers to the dihedral angle unless expressly indicated otherwise. Similarly, an angle of a plane or surface relative to vertical or horizontal refers to the dihedral angle to a reference vertical or horizontal plane. The dihedral angle is measured in a plane that is perpendicular to the line of intersection of the planes (also referred to herein as the "dihedral line"). As used herein, the term "dihedral angle" infers that there are two intersecting planes or two surfaces disposed at an angle to one another. A dihedral angle may be formed by surfaces of separate objects or by two surfaces of the same object.

Figure 1:
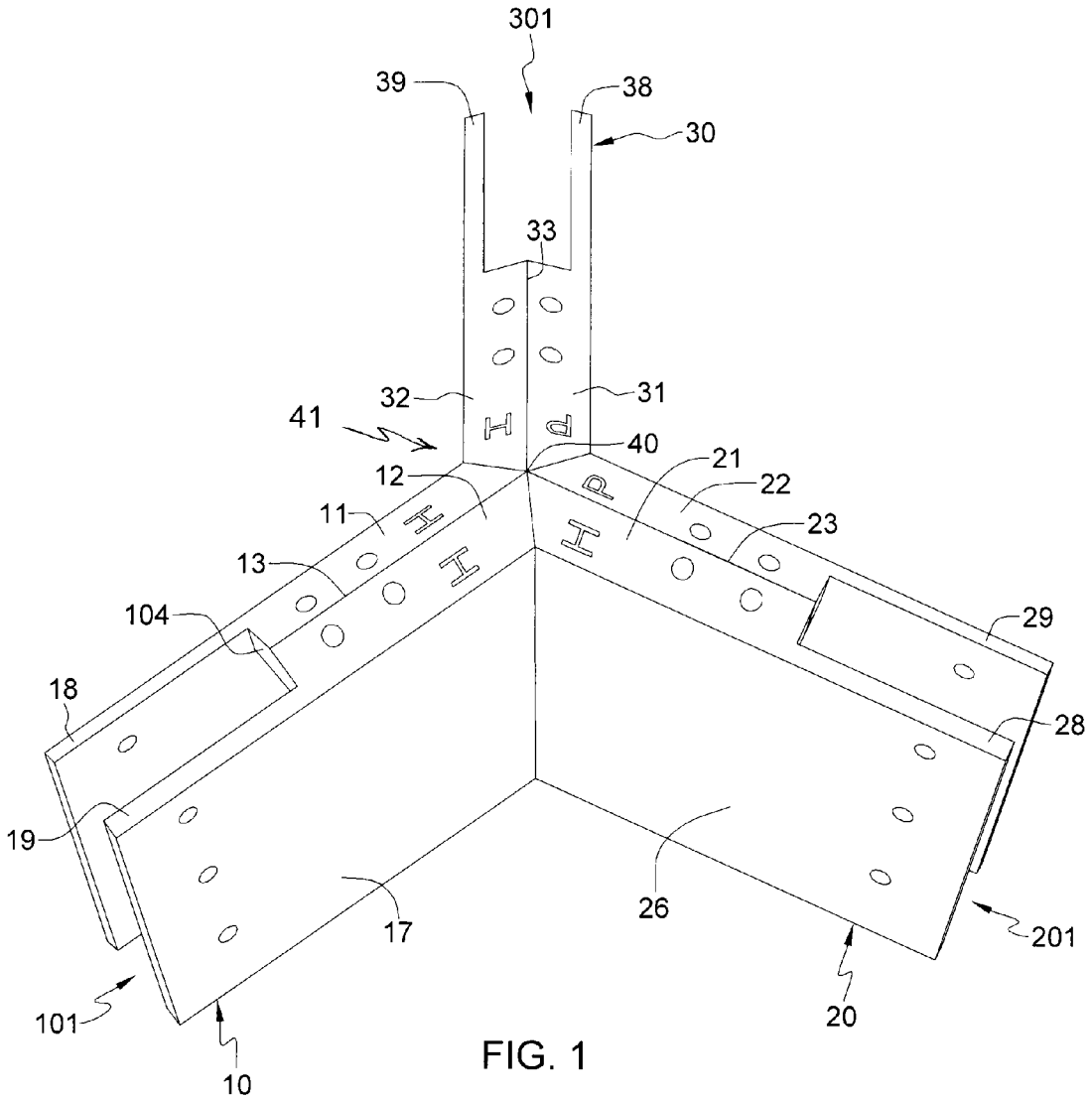
FIG. 1 is a perspective view from above of one embodiment of a beam connector of the present invention.
Figure 7A:
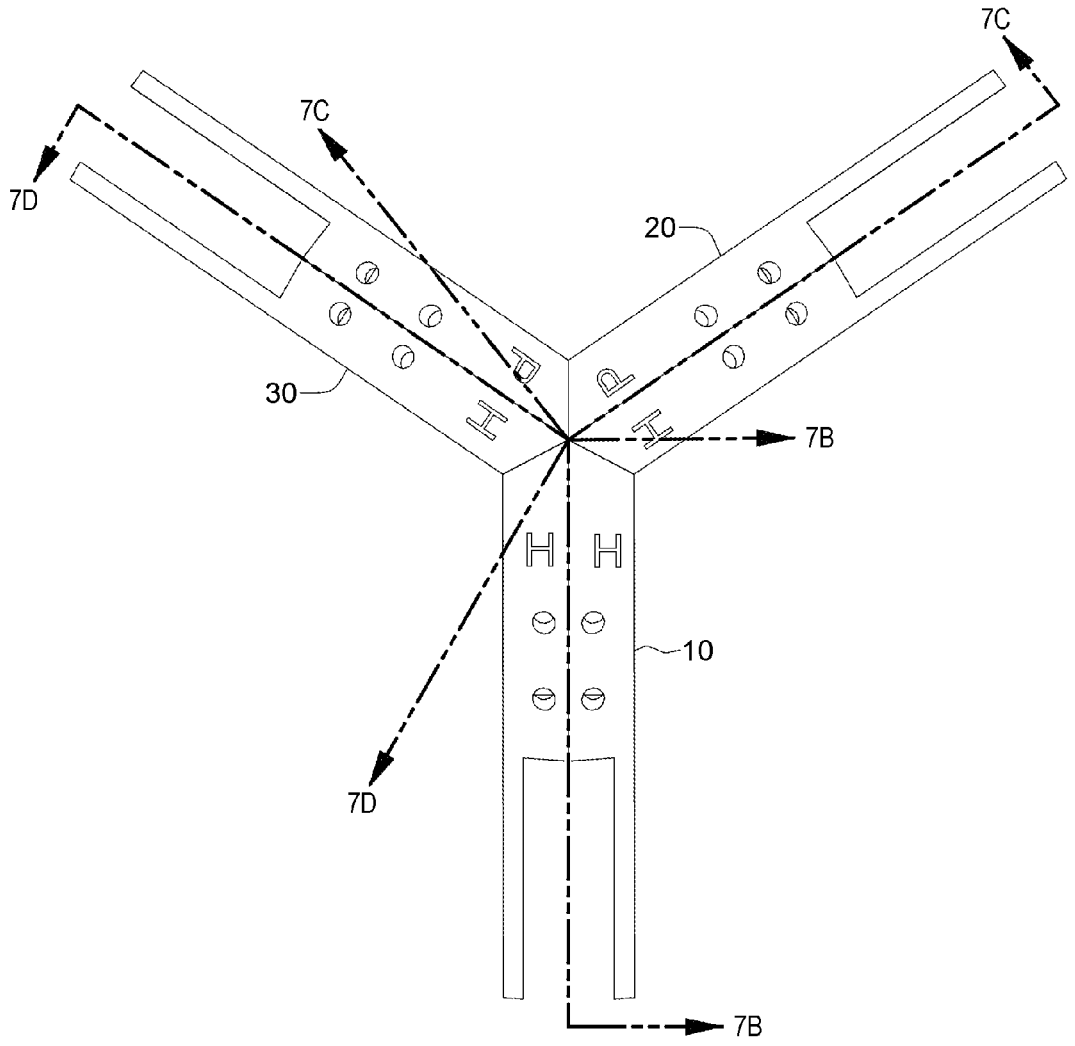
FIG. 7A is another top view of the beam connector of FIG. 1 with cross section lines indicated.
Figure 7B:
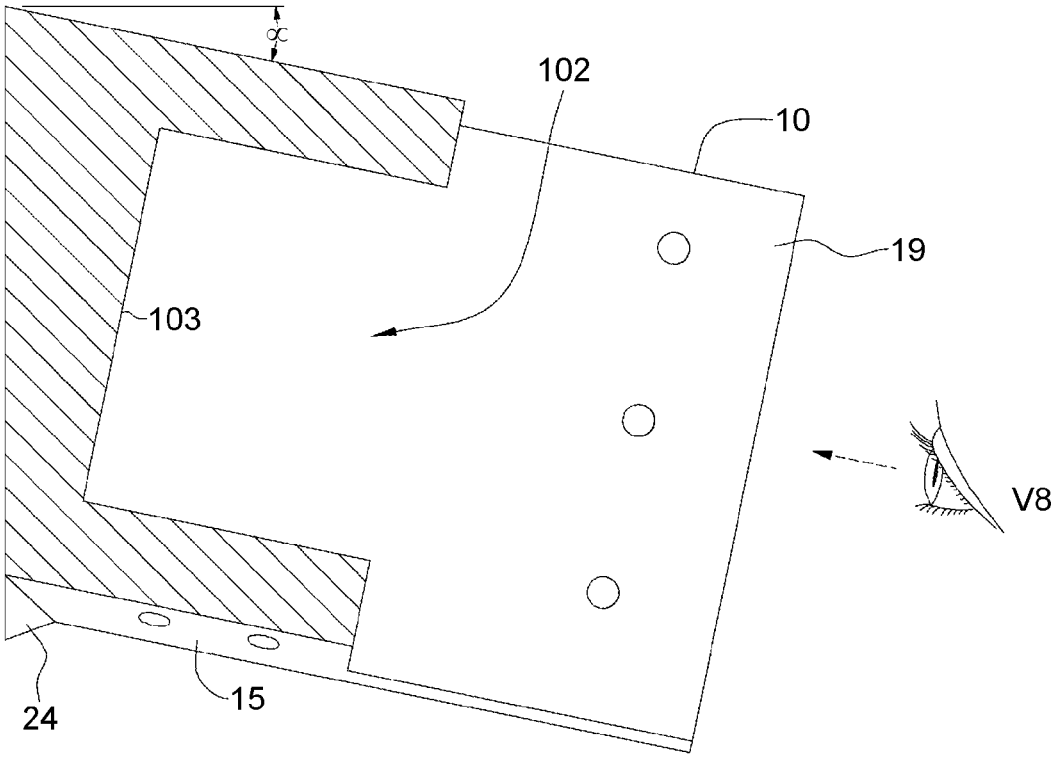
FIG. 7B is a cross section along cross section line 7B-7B of FIG. 7A.
Figure 7C:
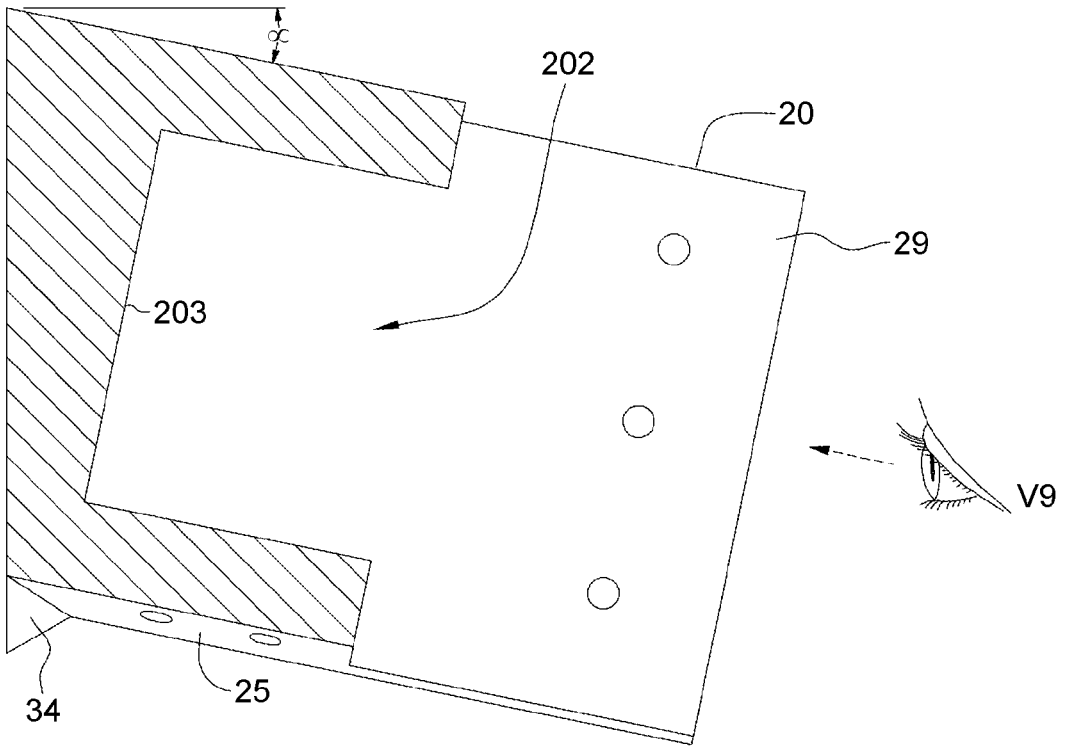
FIG. 7C is a cross section along cross section line 7C-7C of FIG. 7A.
Figure 7D:
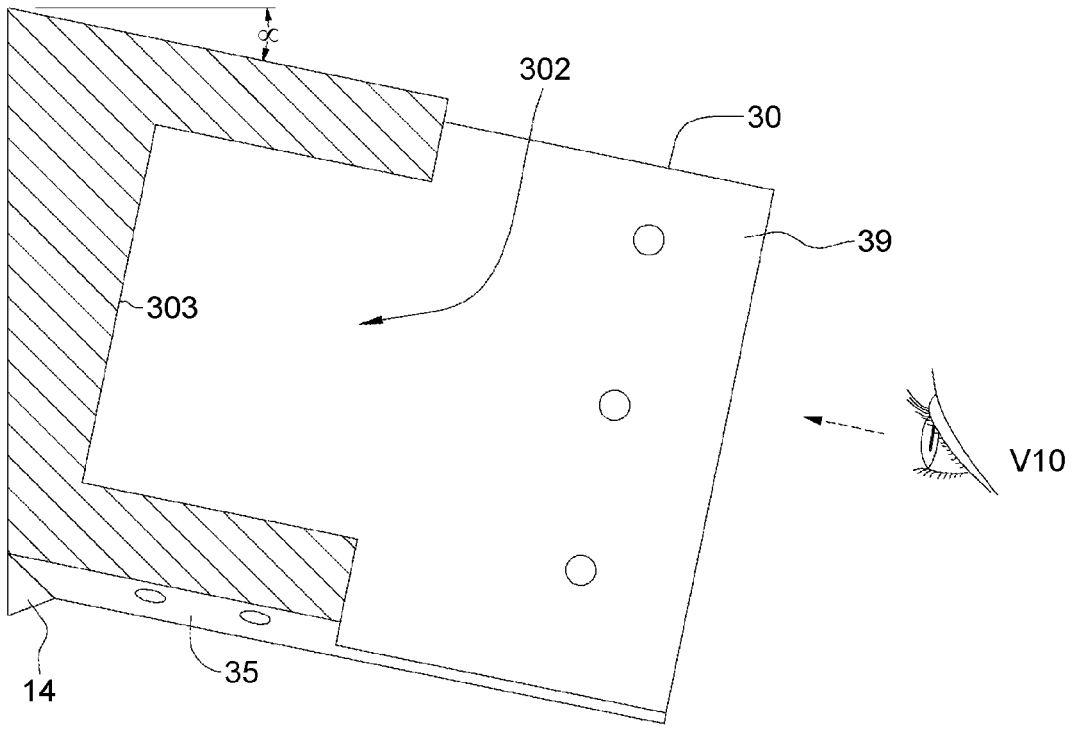
FIG. 7D is a cross section along cross section line 7D-7D of FIG. 7A.

With reference to FIG. 1, in a preferred embodiment, the improved beam connector comprises three legs 10, 20 and 30 extending radially outward from an axis through the center 40. Although connectors of the present invention may be disposed in various orientations in a structure, for the purposes of describing a connector herein, the center axis is assumed to be vertical. With further reference to FIGS. 7B-7D, each leg extends outward at a downward longitudinal pitch angle $\alpha$ of about 11.64°. Said pitch angle is measured from horizontal.

Figure 5:
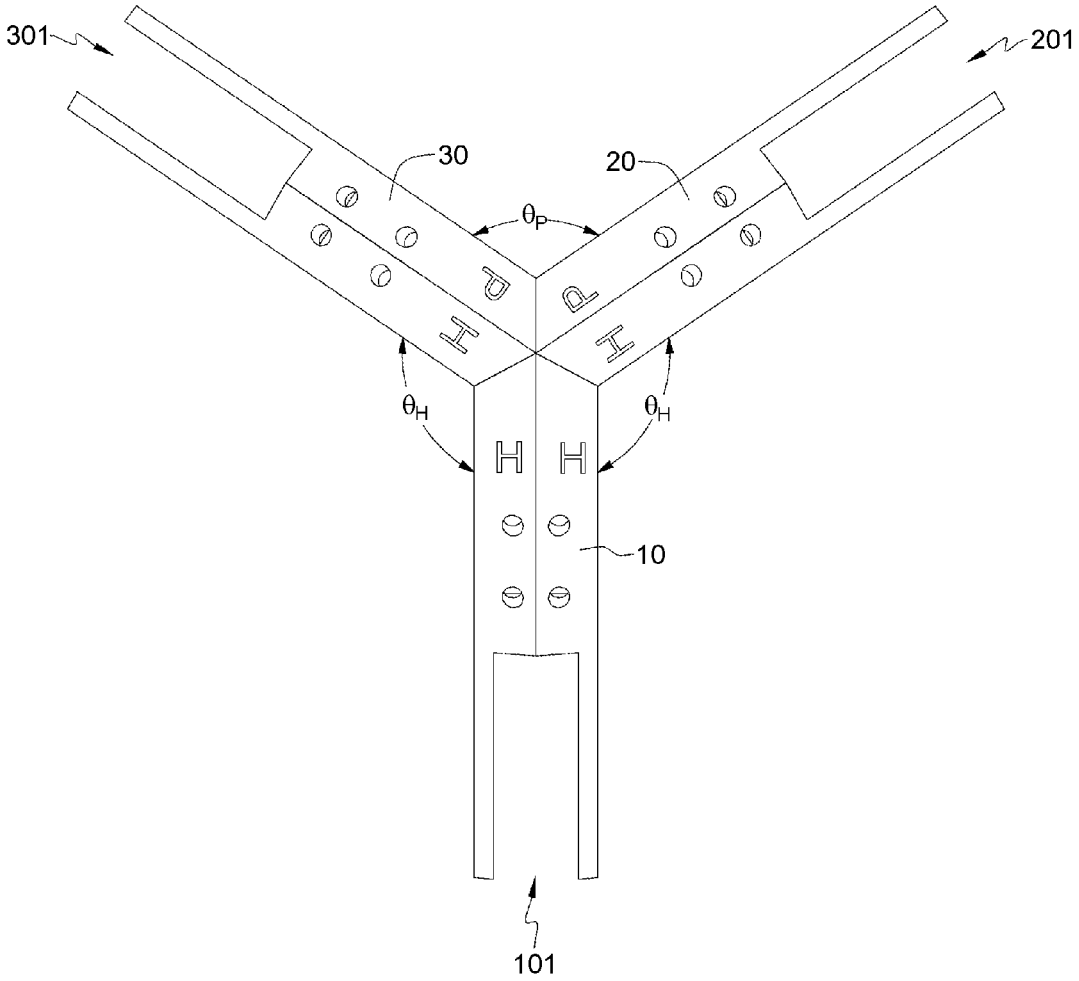
FIG. 5 is a top plan view of the beam connector of FIG. 1.

With further reference to FIG. 5, leg 20 is disposed at angle $\theta H$ of about 124.31° counterclockwise from leg 10, leg 30 is disposed at angle $\theta P$ of about 111.38° counterclockwise from leg 20, and leg 10 is disposed at angle $\theta H$ of about 124.31° counterclockwise from leg 30.

A line running in the same angular direction as a leg, through the center axis of the beam connector, and at the same pitch angle $\alpha$ of a leg may be referred to herein as the "pitch line" of the leg.

The legs divide space around the center into three "sectors." In a completed structure such as a dome, the sectors will be covered by panels attached to the connector. Two hexagonal panels and one pentagonal panel may be assembled to each connector (see FIGS. 11-19), and the corresponding sectors may be referred to as hexagonal sectors and pentagonal sectors. The sides of legs bounding a hexagonal sector and the sides bounding a pentagonal sector may be designated "H" and "P", respectively. Leg surfaces may be provided with appropriate "H" and/or "P" markings. One leg has two hexagonal sides and two legs have a hexagonal side and pentagonal side as indicated in FIG. 1.

The two hexagonal panels and the pentagonal panel assembled to a connector are each oriented in a different plane from one another and their respective planes form a dihedral angle at their lines of intersection (also referred to herein as "dihedral lines"). In a preferred embodiment, the three panels form three dihedral angles on three dihedral lines that radiate outward from the center of the connector at the same pitch angle as the legs and same angular direction as the legs.

With reference to FIG. 1, in a preferred embodiment, the upper portion of leg 10 comprises top surface 11 and top surface 12. Surfaces 11 and 12 are flat and are disposed in different planes from one another. Surfaces 11 and 12 form a ridge 13 along pitch angle $\alpha$ of the leg. Surface 11 is for providing support to a hexagonal panel, and surface 12 is for providing support to another hexagonal panel.

Figure 8A:
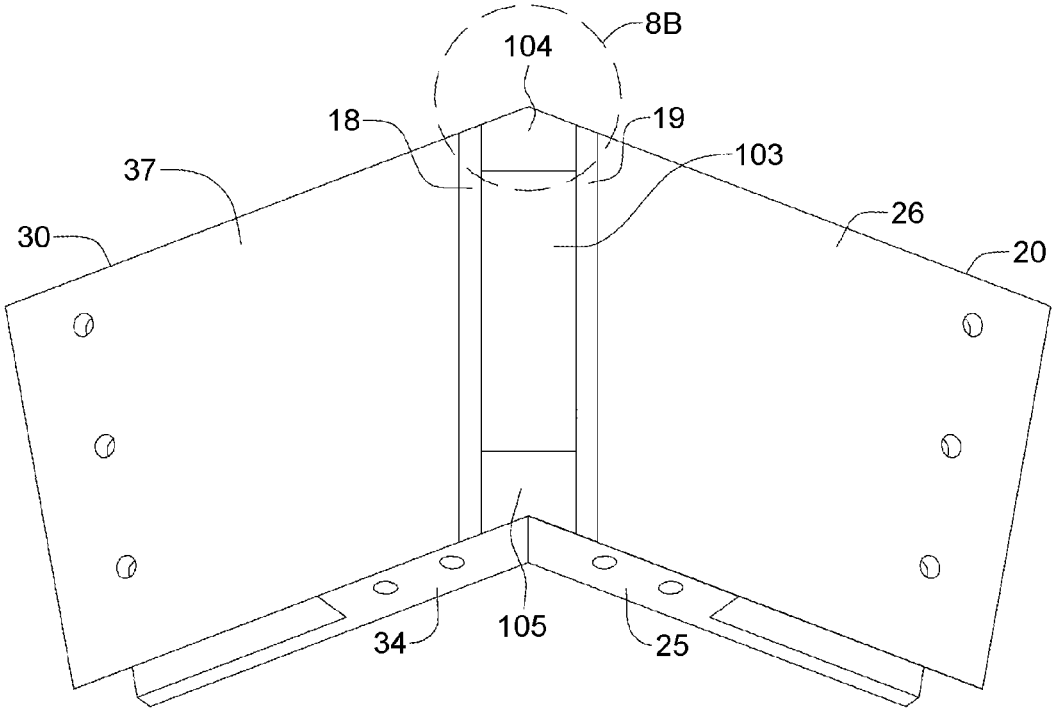
FIG. 8A is a plan view of the beam connector of FIG. 1 looking directly at the end of leg 10 along the direction of the pitch of the leg from view "V8" of FIG. 7B.
Figure 8B:
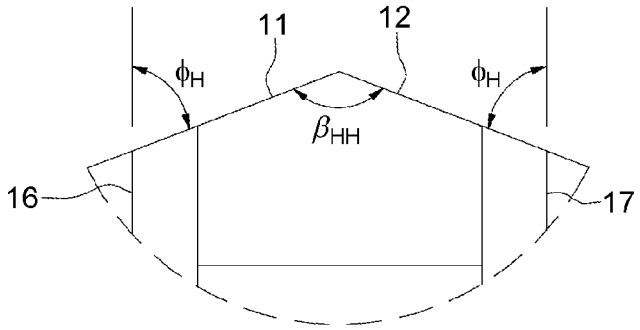
FIG. 8B is a close-up view of a feature 8B of FIG. 8A.

With reference to FIG. 8B, surfaces 11 and 12 form dihedral angle βHH° of about 138.19° along the ridge. Angle ϕH° between surface 11 and surface 16 is about 69.09°. Likewise, angle ϕH° between surface 12 and surface 17 is about 69.09°. The edge formed by surfaces 11 and 16 and the edge formed by surfaces 12 and 17 are parallel to ridge 13.

Figure 9A:
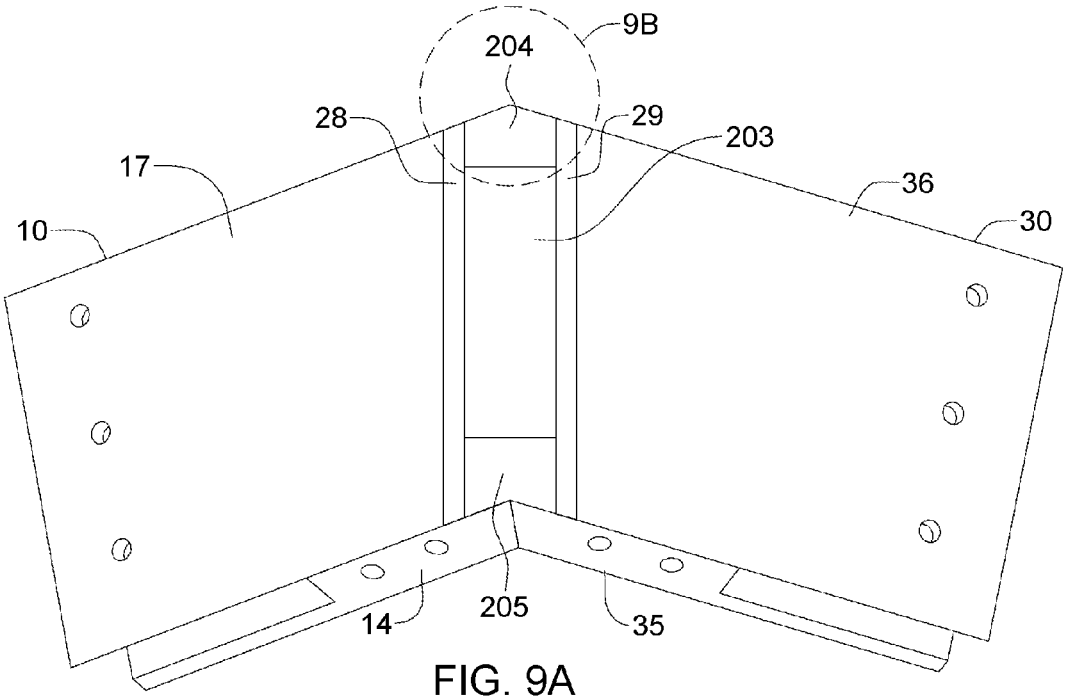
FIG. 9A is a plan view of the beam connector of FIG. 1 looking directly at the end of leg 20 along the direction of the pitch of the leg from view "V9" of FIG. 7C.
Figure 9B:
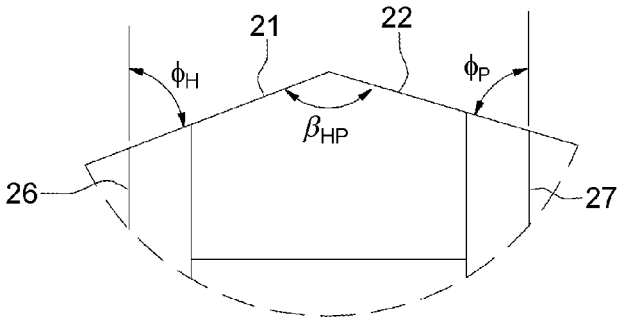
FIG. 9B is a close-up view of a feature 9B of FIG. 9A.

With reference to FIG. 1, in a preferred embodiment, the upper portion of leg 20 comprises top surface 21 and top surface 22. Surfaces 21 and 22 are flat and are disposed in different planes from one another. Surfaces 21 and 22 form a ridge 23 along pitch angle α of the leg. Surface 21 is for providing support to a hexagonal panel, and surface 22 is for providing support to a pentagonal panel. With reference to FIG. 9B, surfaces 21 and 22 form dihedral angle βHP° of about 142.62° along the ridge. Angle ϕH° between surface 21 and surface 26 is about 69.09°. Angle ϕP° between surface 22 and surface 27 is about 73.53°. The edge formed by surfaces 21 and 26 and the edge formed by surfaces 22 and 27 are parallel to ridge 23.

Figure 10A:
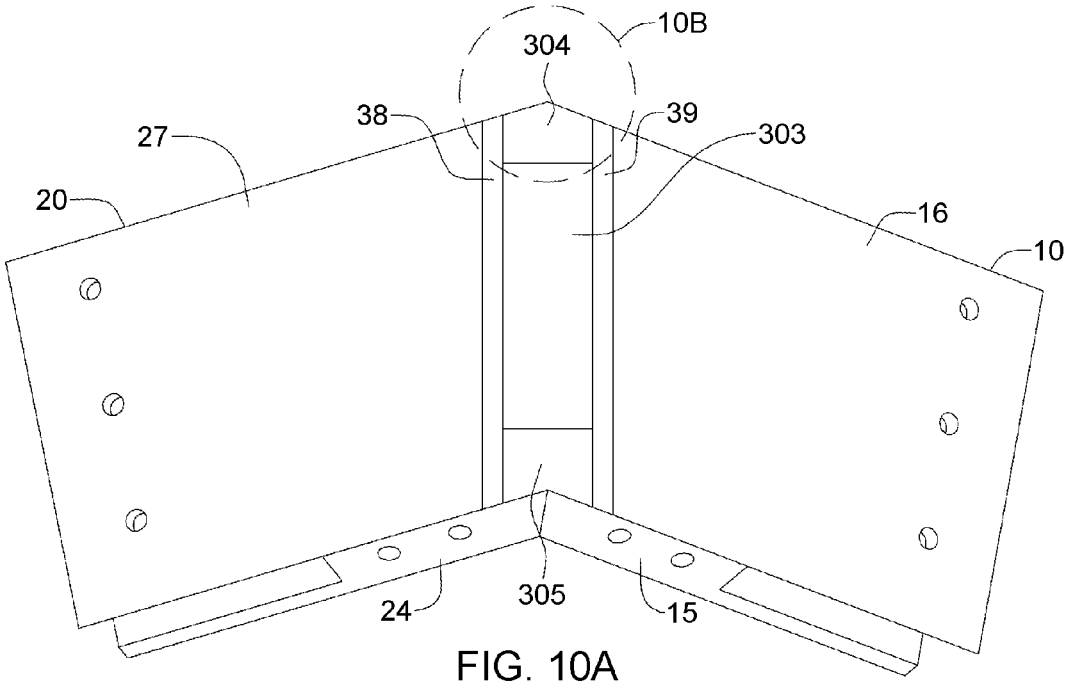
FIG. 10A is a plan view of the beam connector of FIG. 1 looking directly at the end of leg 30 along the direction of the pitch of the leg from view "V10" of FIG. 7C.
Figure 10B:
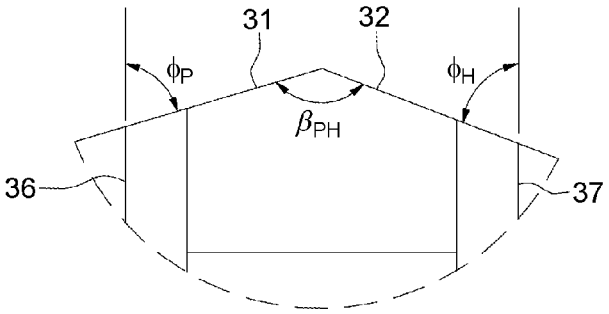
FIG. 10B is a close-up view of a feature of 10B FIG. 10A.

With reference to FIG. 1, in a preferred embodiment, the upper portion of leg 30 comprises top surface 31 and top surface 32. Surfaces 31 and 32 are flat and are disposed in different planes from one another. Surfaces 31 and 32 form a ridge 33 along pitch angle α of the leg. Surface 31 is for providing support to a pentagonal panel, and surface 32 is for providing support to a hexagonal panel. With reference to FIG. 10B, surfaces 31 and 32 form dihedral angle βPH° of about 142.62° along the ridge. Angle ϕP° between surface 31 and surface 36 is about 73.53°. Angle ϕH° between surface 32 and surface 37 is about 69.09°. The edge formed by surfaces 31 and 36 and the edge formed by surfaces 32 and 37 are parallel to ridge 33.

Figure 4:
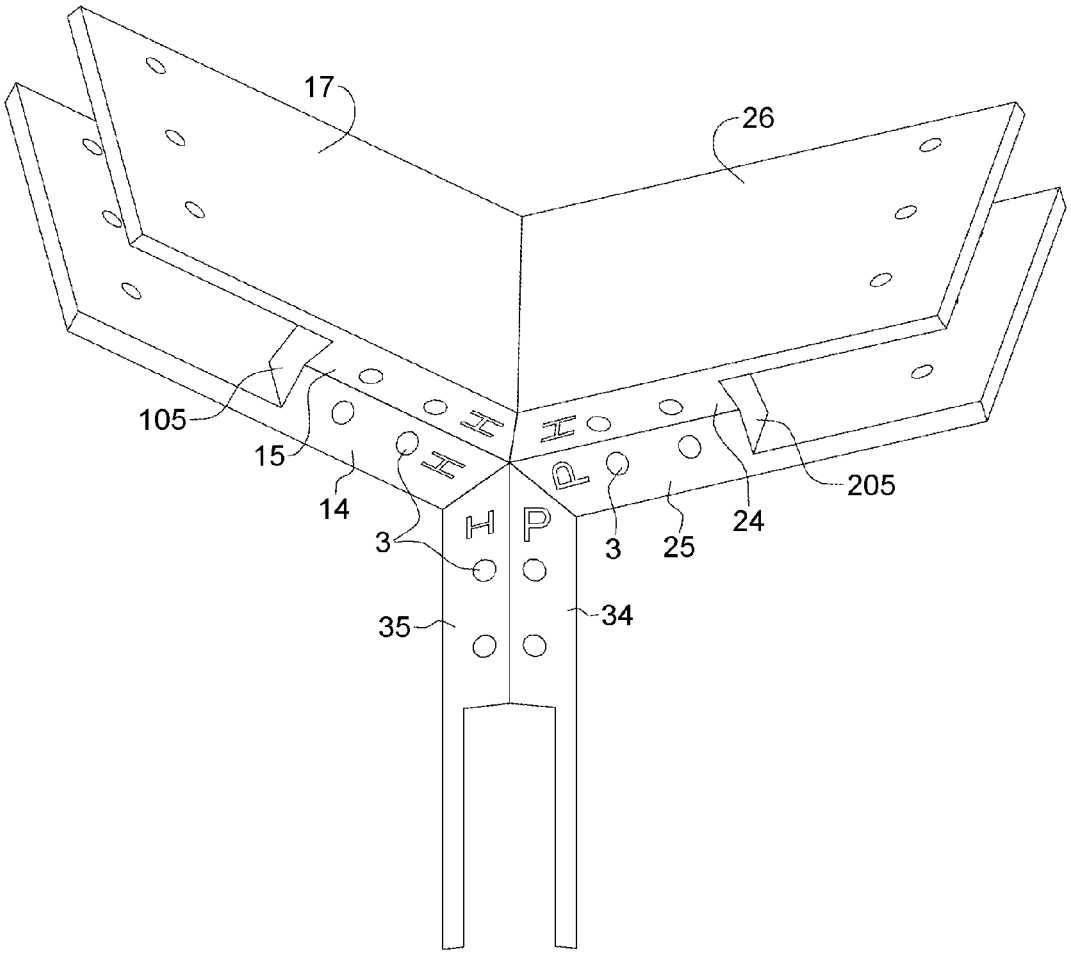
FIG. 4 is a perspective view of the beam connector of FIG. 1 from beneath the connector.
Figure 6:
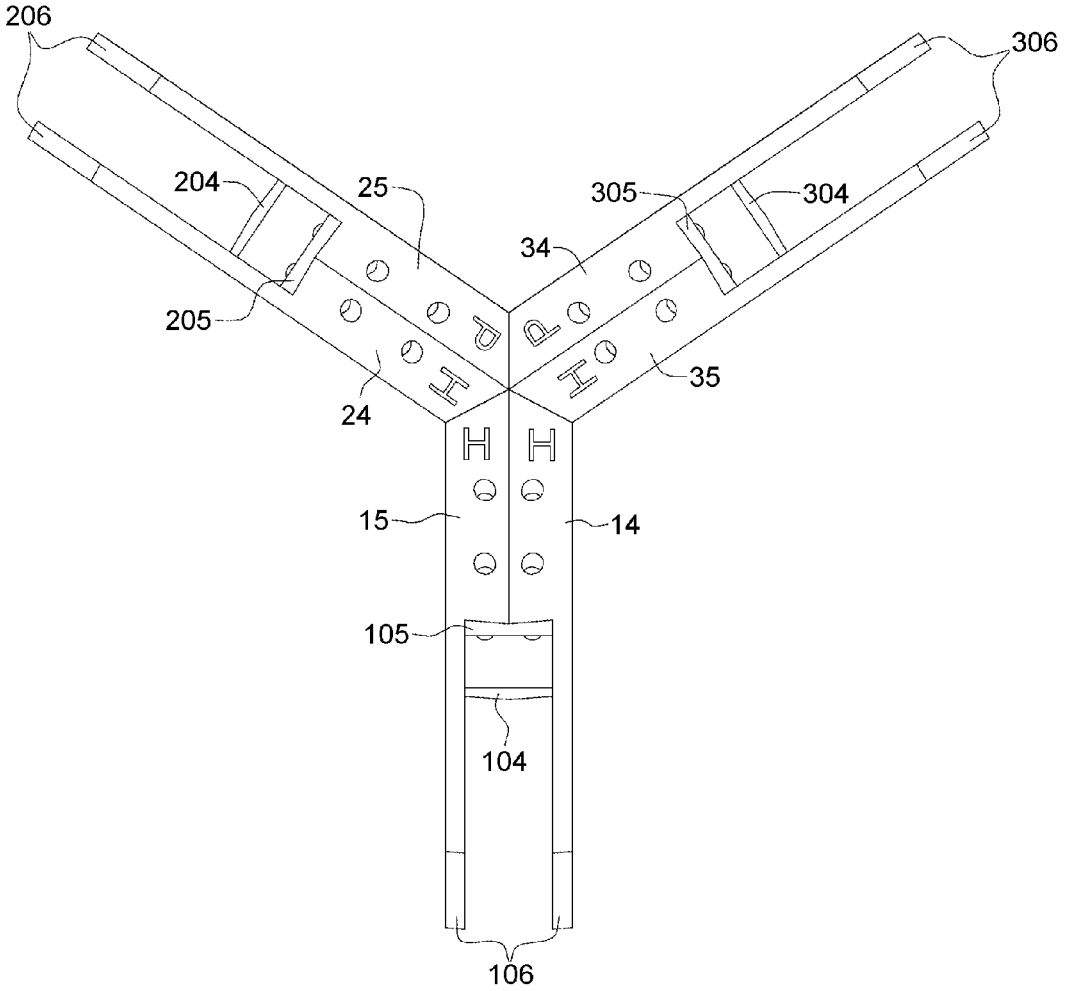
FIG. 6 is a bottom plan view of the beam connector of FIG. 1.

With reference to FIGS. 4 and 6, bottom surfaces 14 and 15 of leg 10, bottom surfaces 24 and 25 of leg 20, and bottom surfaces 34 and 35 of leg 30 are parallel to their corresponding top surfaces (11 and 12, 21 and 22, and 31 and 32, respectively) so that they form the same dihedral angle as their corresponding top surfaces and a dihedral line that is parallel to the corresponding ridge lines 13, 23 and 33, respectively.

Figure 2:
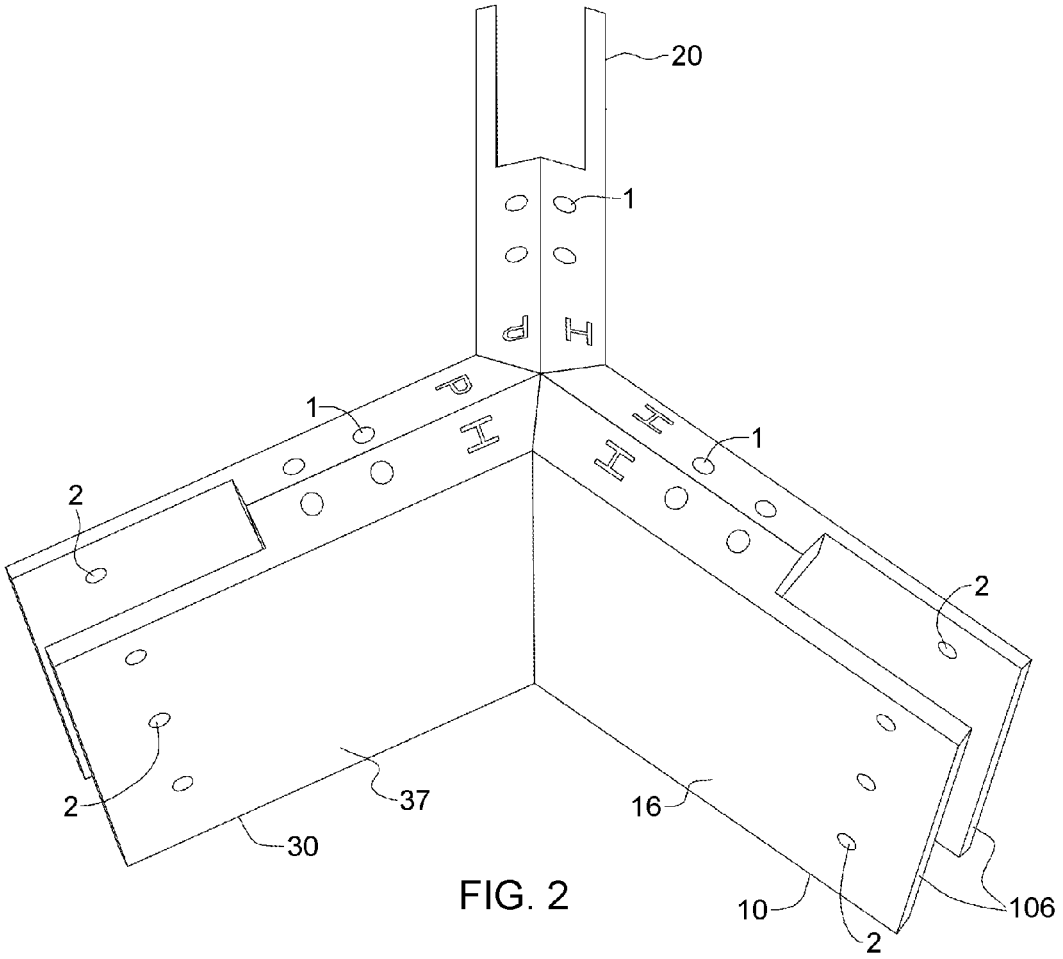
FIG. 2 is another perspective of the beam connector of FIG. 1 from another viewpoint from above the connector.
Figure 3:
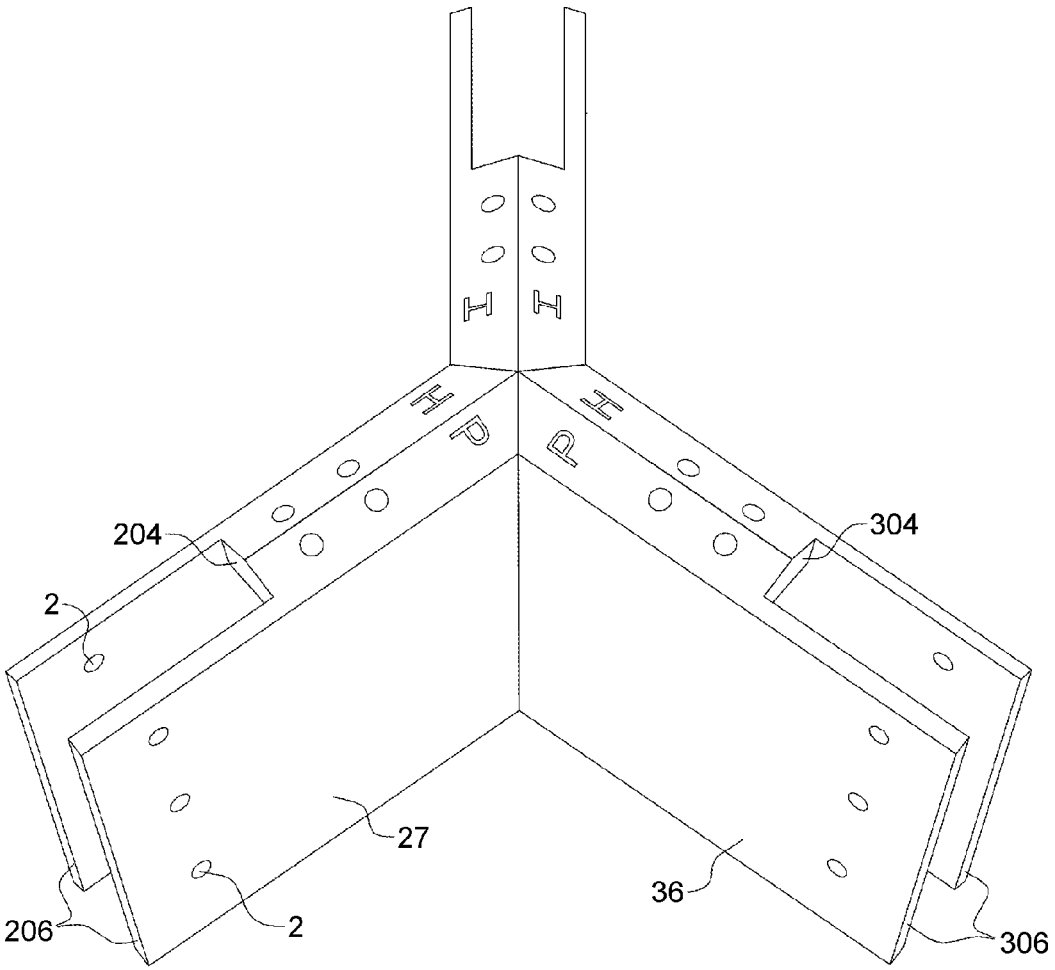
FIG. 3 is another perspective view of the beam connector of FIG. 1 from yet another viewpoint from above the connector.

With reference to FIGS. 1-3, side surfaces 16 and 17 of leg 10 are vertical and parallel to one another and parallel to ridge 13. Likewise, side surfaces 26 and 27 of leg 20 are vertical and parallel to one another and parallel to ridge 23, and side surfaces 36 and 37 of leg 30 are vertical and parallel to one another and parallel to ridge 33.

Although in the preferred embodiment shown in FIGS. 1-10 the top and bottom surfaces of the legs are slanted and flat surfaces that conform to the dihedral shape formed by adjacent flat panels, alternate configurations may be provided as long as the beam connector is appropriately adapted to support the panels. For example, in alternate embodiments, panel edges may be provided with connecting features that are not coplanar with the panel surfaces and the legs may be provided with compatible connecting features. For example, the top surfaces of the legs may be at right angles to the sides of the legs and the panels may be provided with flanges or thick landings configured to conform to and to form a flush fit therewith.

In the preferred embodiment shown in FIGS. 1-10, the outer end surfaces 106, 206 and 306 of the legs are disposed in planes perpendicular to the respective leg's ridge line.

With reference to FIG. 1, leg extensions 18 and 19 of leg 10 form opening 101 for receiving the end of a beam. Likewise in legs 20 and 30, leg extensions 28 and 29 form opening 201 for receiving the end of a beam, and extensions 38 and 39 form opening 301 for receiving the end of a beam.

With reference to FIG. 7B, leg 10 may have a mortise cavity 102 for receiving a correspondingly sized and shaped tenon projection of a beam for forming a mortise and tenon joint. Although mortise and tenon joints commonly join perpendicularly aligned beams, in the preferred embodiment of this invention the beam is aligned longitudinally with the pitch of the leg. With reference to see FIGS. 1, 4, 6 and 8, leg 10 of the connector comprises top shoulder surface 104 and bottom shoulder surface 105 adjacent to the mortise cavity for mating with a corresponding shoulder surface of a beam adjacent to the beam tenon. Likewise, with further reference to FIGS. 3, 4, 6, 9 and 10, leg 20 may have mortise cavity 202 and top and bottom shoulders 204 and 205, and leg 30 may have mortise cavity 302 and top and bottom shoulders 304 and 305.

In an alternate embodiment, beams may be provided without tenons, in which case leg extensions 18, 19, 28, 29, 30 and 39 and openings 101, 201 and 301 provide for ease of assembly as beams may be slid into place between the leg extensions into the openings through the end of the openings or the top or bottom sides of the openings. A combination of beams with and without tenons may also be used. For example, tenons on the final beam of a geodesic sphere frame may interfere with assembly, and the beam may be provided without tenons so that each end of the beam may be slid sideways into connector openings.

With reference to FIGS. 2 and 4, in a preferred embodiment, the legs may be provided with holes 1, 2 and 3 for receiving fasteners for fastening beams and panels to the beam connector. The fasteners may comprise threaded fasteners, dowels, nails, pins, or any other suitable type of fastener. Holes 1 are for fastening exterior panels to the top of the leg, holes 3 are for fastening interior panels to the bottom of the leg, and holes 2 are for fastening beams to the leg. Holes 1 and 3 may be aligned so that a single fastener may run through the connector from top to bottom, and holes 2 on either side of the leg may likewise be aligned so that a single fastener may run through the connector from side to side.

Figure 11:
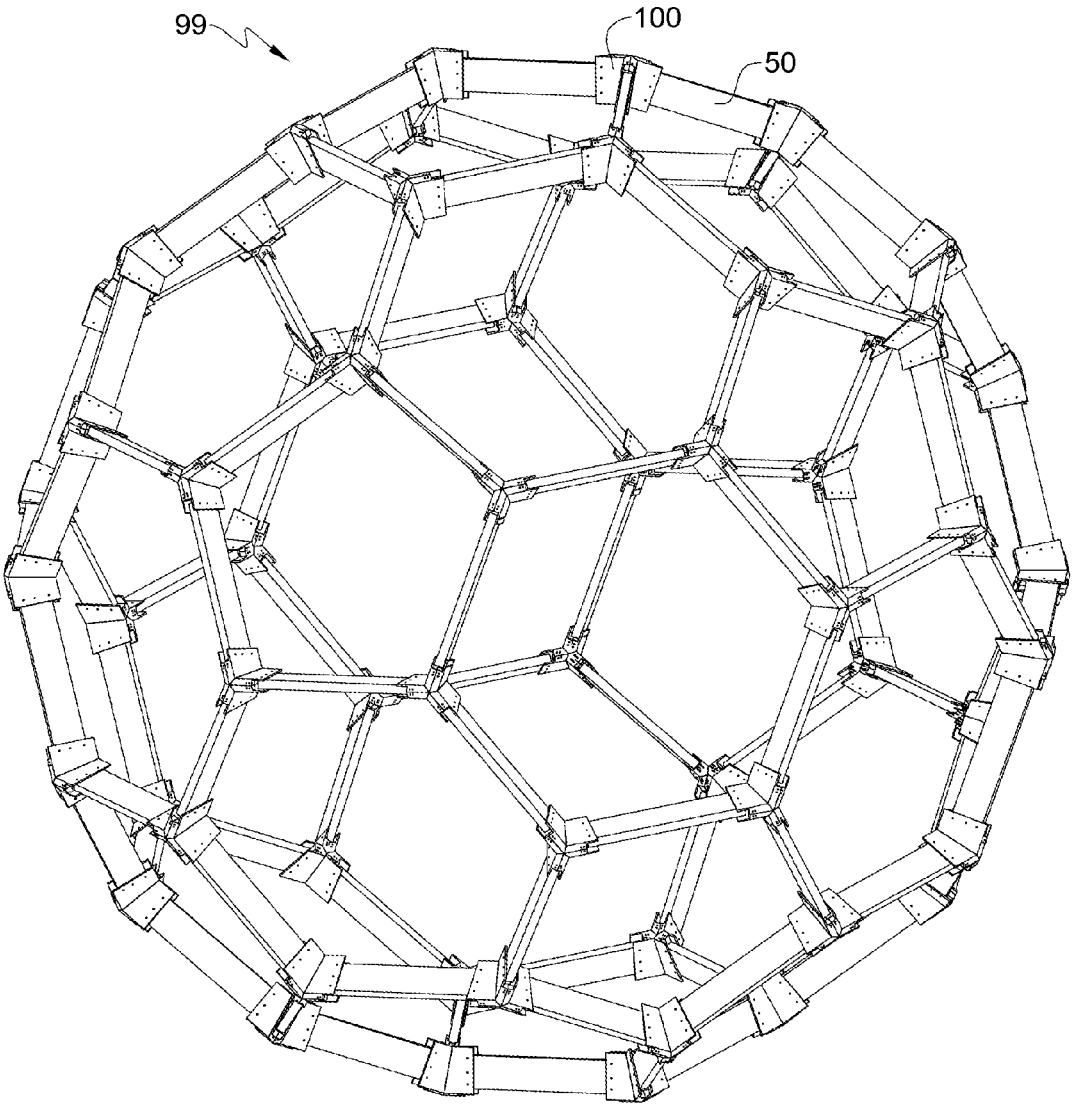
FIG. 11 is a view of an entire geodesic sphere of the present invention without panels.
Figure 12:
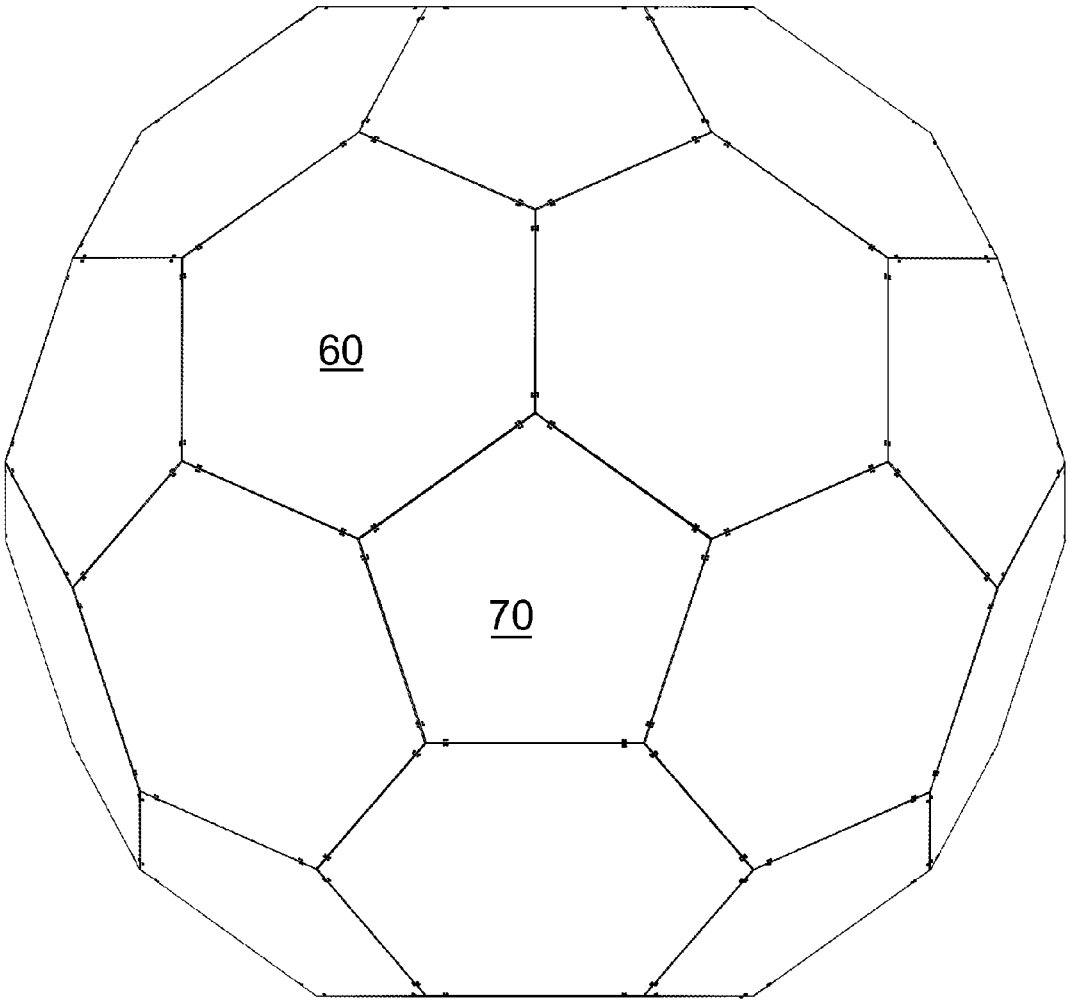
FIG. 12 is a Front view of entire geodesic sphere of the present invention with exterior panels.
Figure 13:
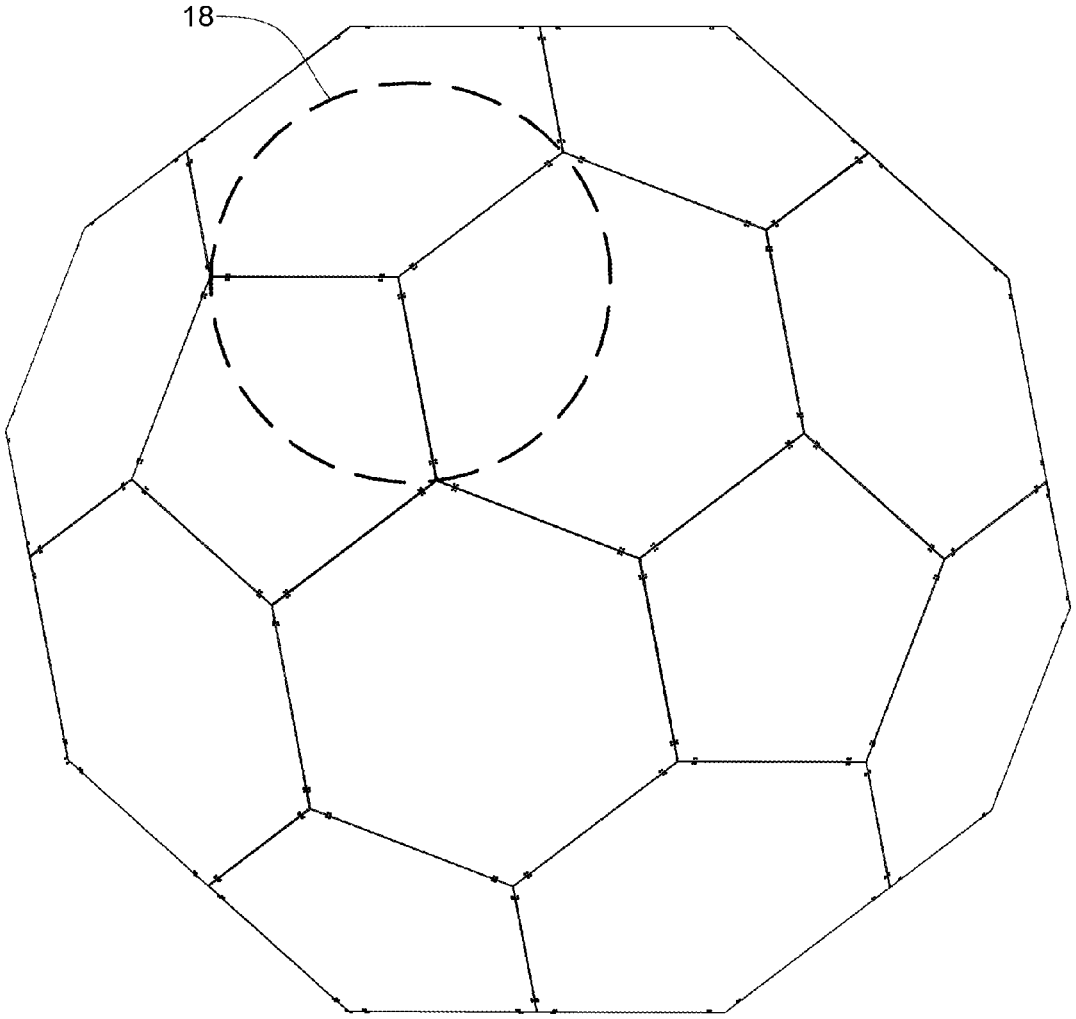
FIG. 13 is a Right side view of FIG. 12.
Figure 14:
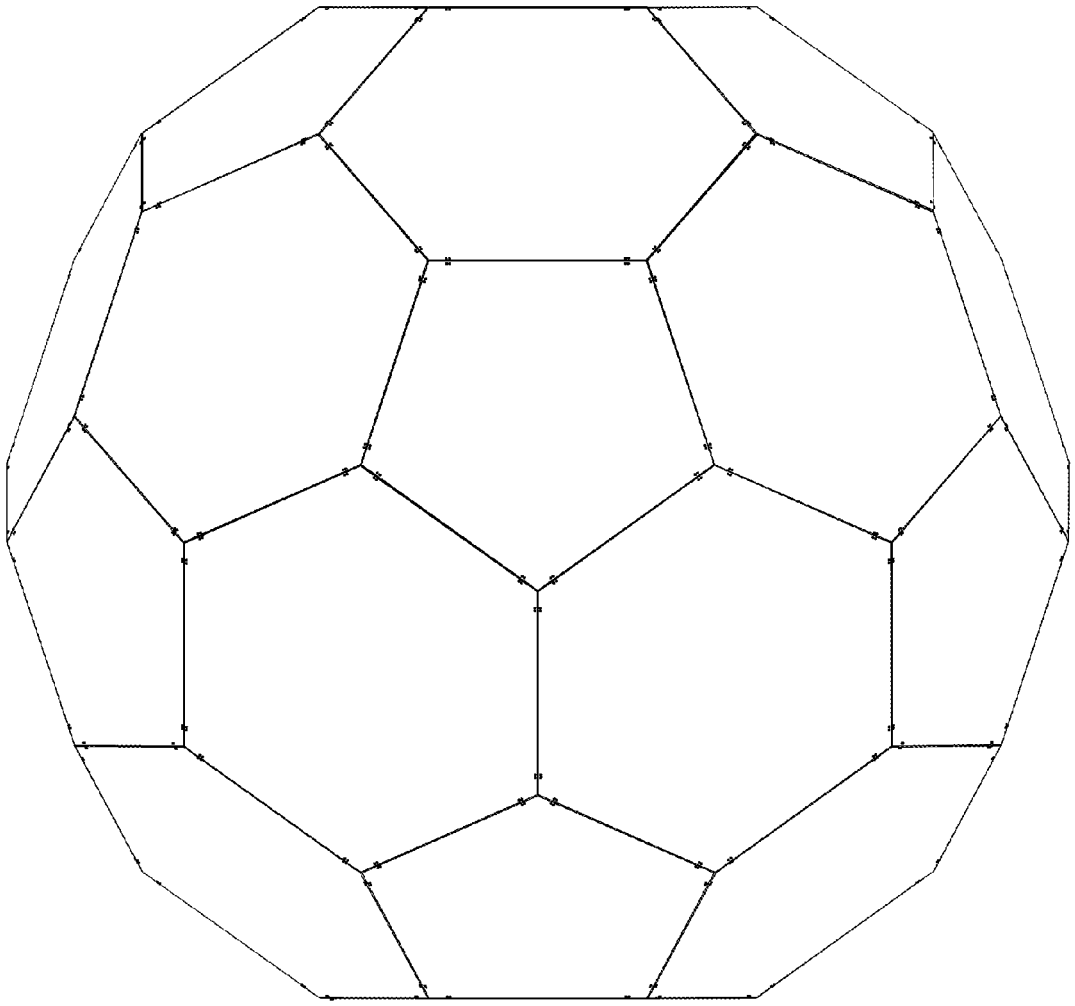
FIG. 14 is a Back view of FIG. 12.
Figure 15:
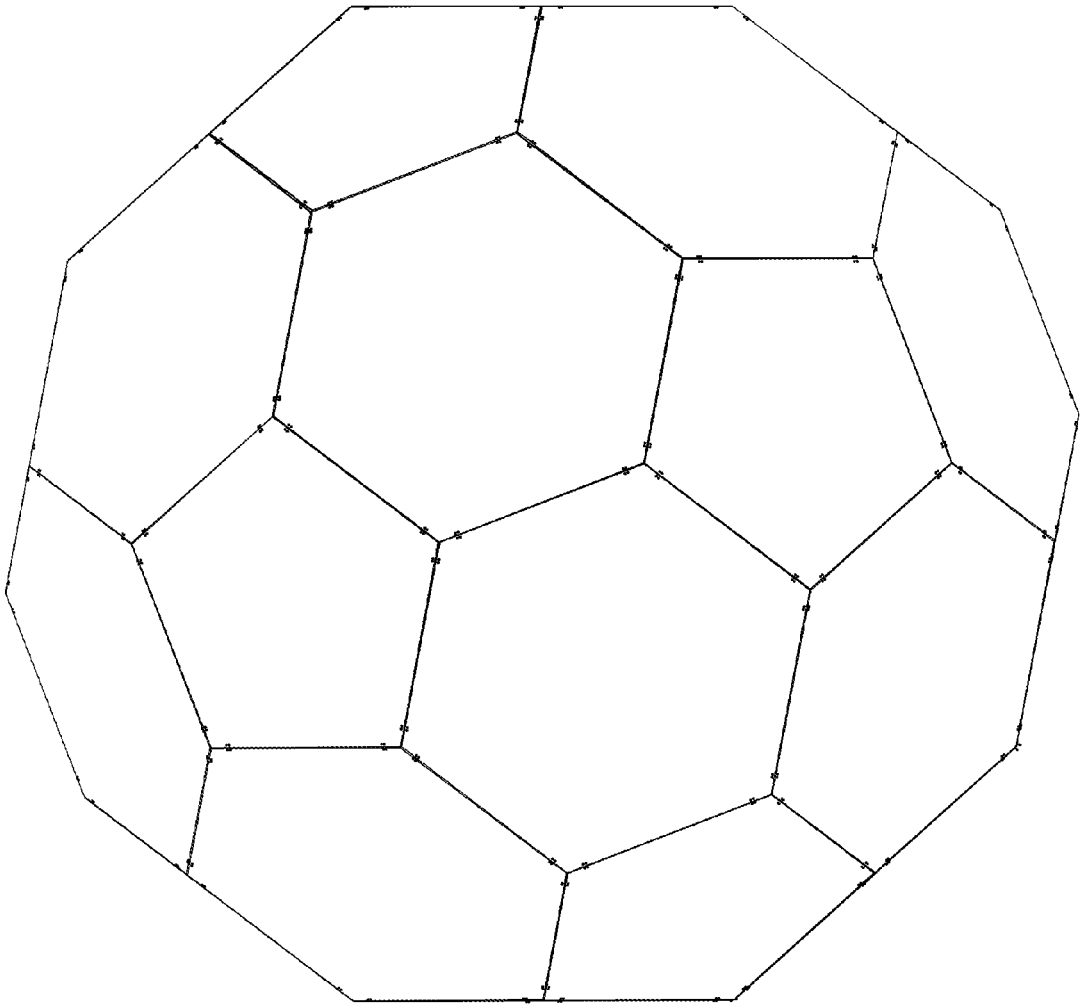
FIG. 15 is a Left side view of FIG. 12.
Figure 16:
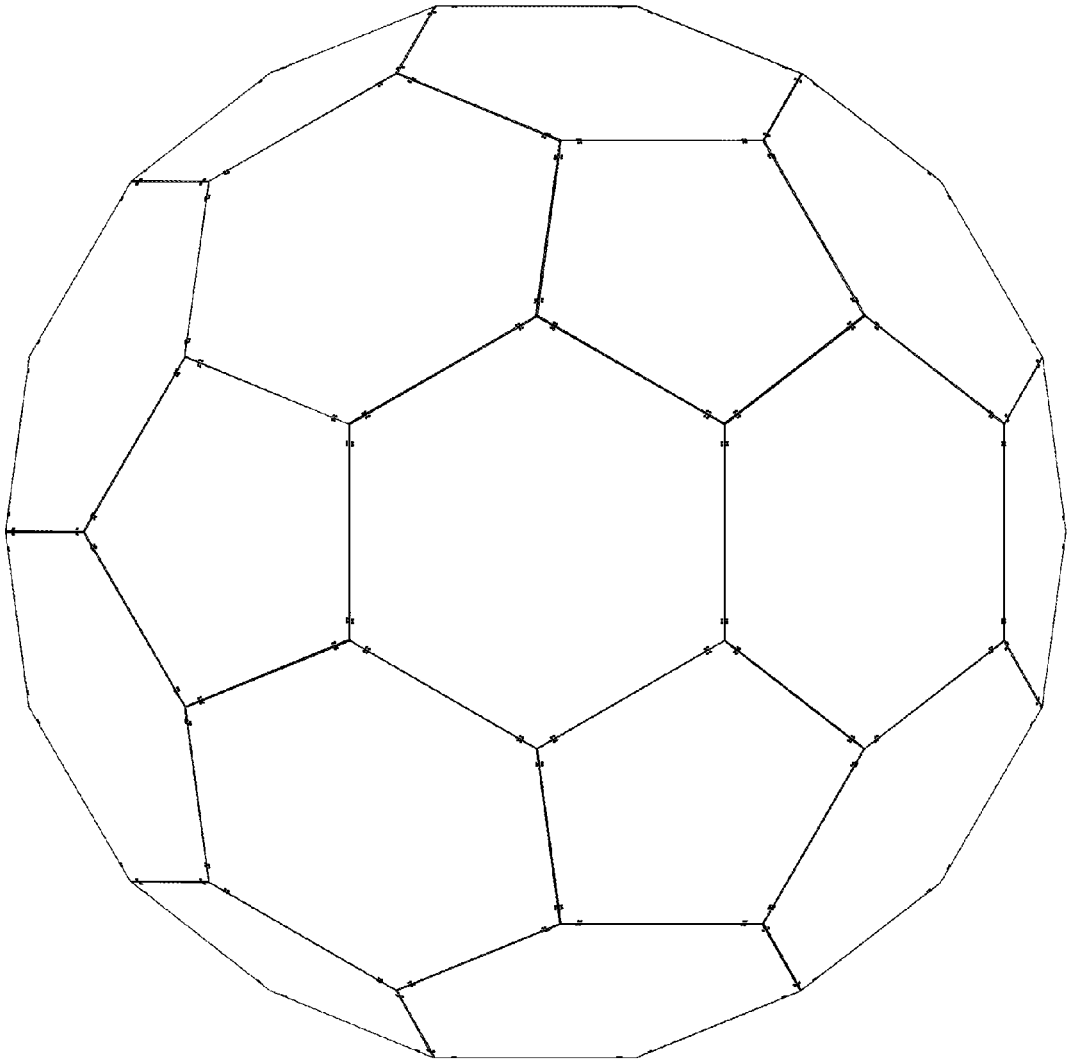
FIG. 16 is a Top view of FIG. 12.
Figure 17:
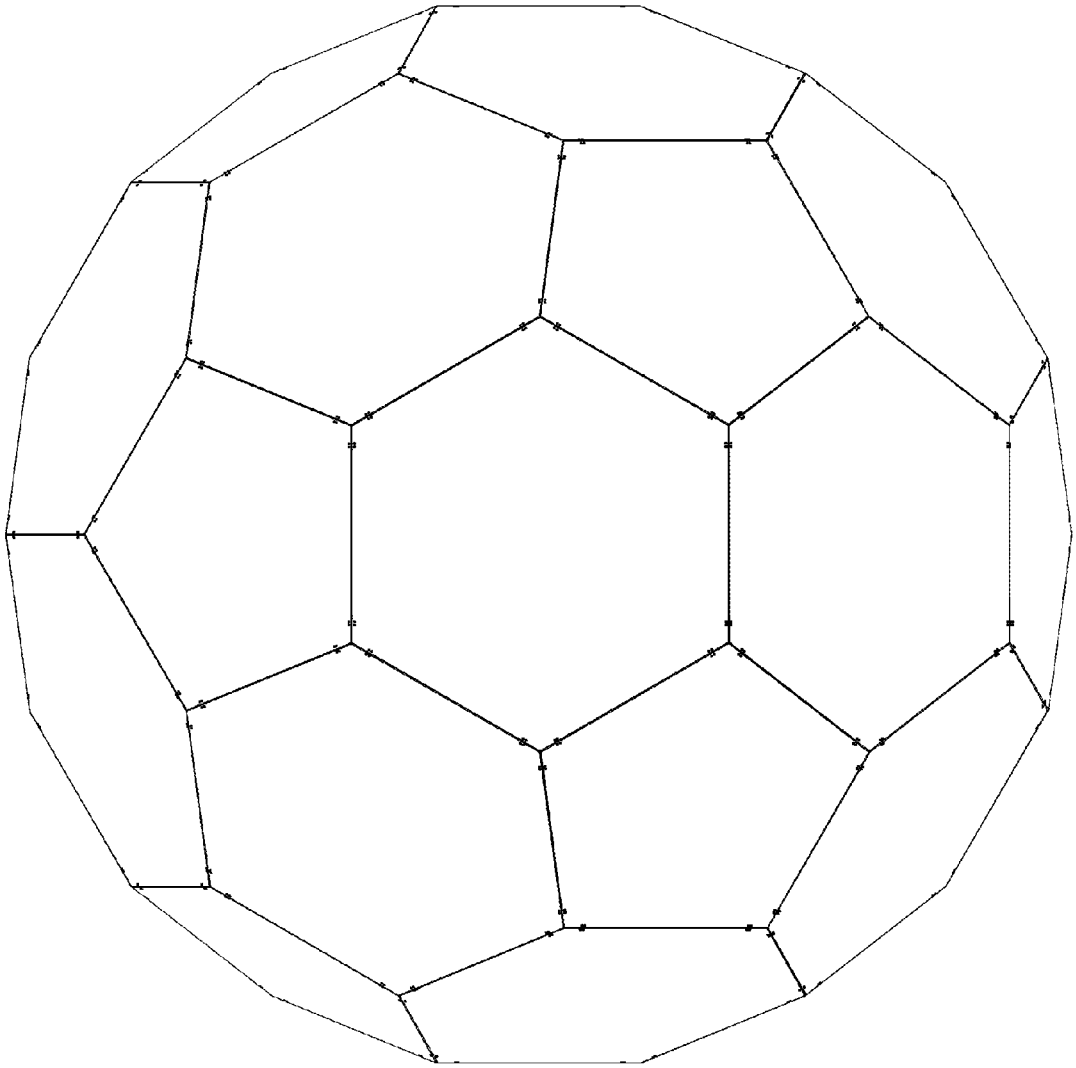
FIG. 17 is a Bottom view of FIG. 12.
Figure 18:
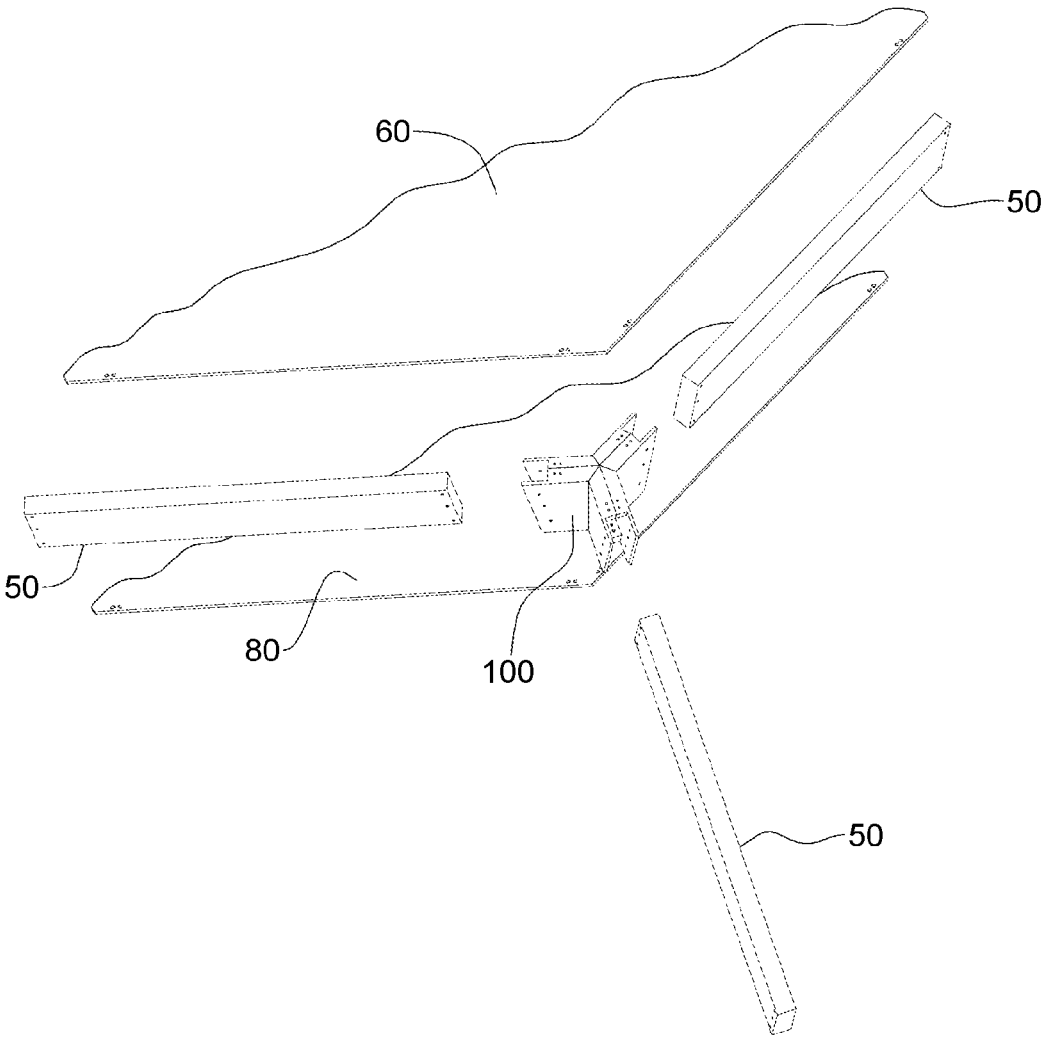
FIG. 18 is an exploded partial view of 3-panel joint 18 of FIG. 13.

With reference to FIG. 11, the improved beam connector of the present invention provides for the construction of an entire geodesic sphere frame 99, or a portion thereof such as a dome, using a plurality of beam connectors 100 having the same size and shape and a plurality of beams 50 having the same size and shape.

Figure 19:
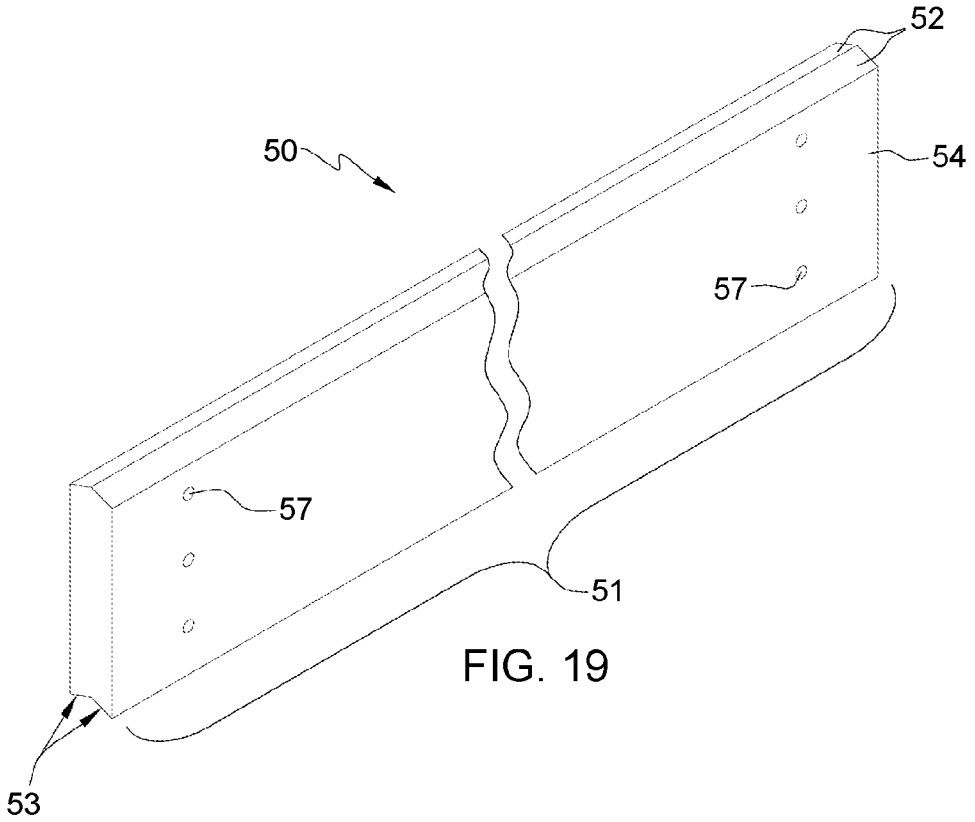
FIG. 19 is a perspective view of a beam of the present invention.
Figure 20:
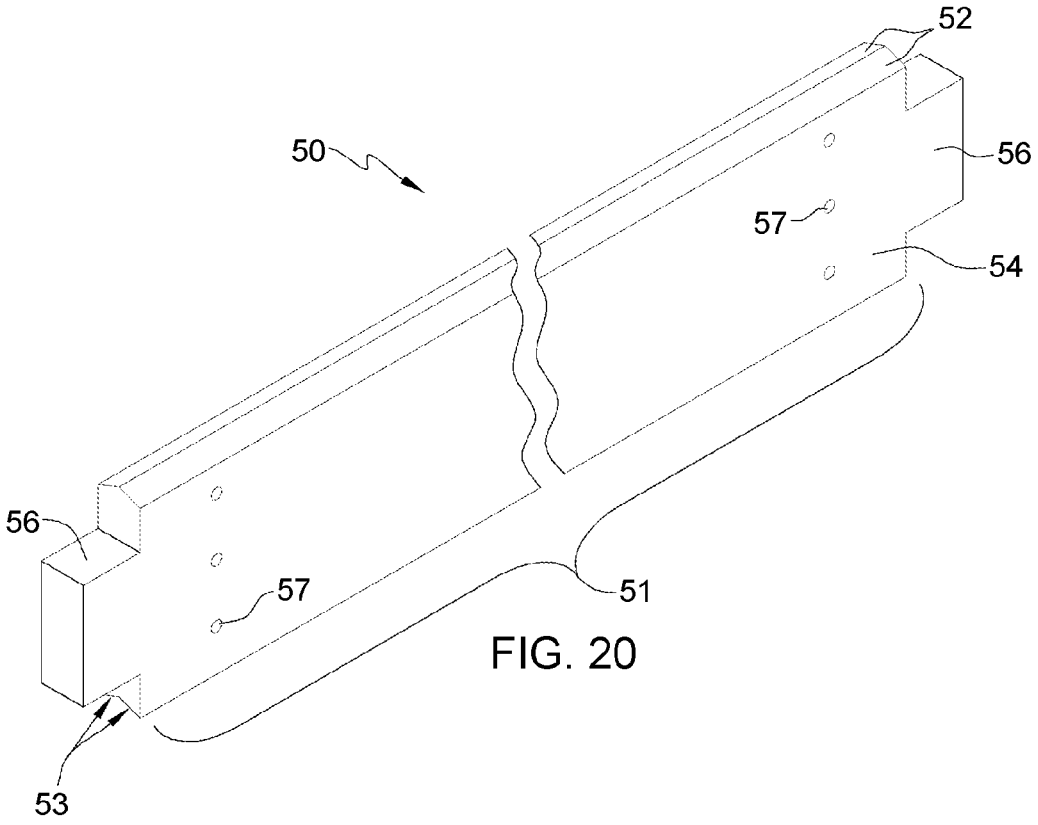
FIG. 20 is a perspective view of another beam of the present invention.

With reference to FIGS. 19 and 20, beam 50 may comprise a span portion 51 having a top surface 52, bottom surface 53, side surfaces 54 and fastener holes 55. Beam 50 may further comprise tenon 56. The beam may have fastener holes 57. Beam top and bottom surfaces 52 and 53 may be adapted to directly support and connect with panels, for example, they may have a dihedral shape conforming to the shape of the beam connector legs, or they may be provided with other connecting structure compatible with corresponding connecting structure of the panels.

Beam length of FIG. 11 is chosen for illustration purposes and does not necessarily represent the beam length of a dwelling or other inhabitable geodesic structure. Beam length may be chosen according to the desired size of the geodesic structure. While adhering to angular specifications, linear dimensions of beam connectors may be chosen according to design preferences, such as to be compatible with chosen beam thickness and width, or to provide desired strength or assembly characteristics.

The spacing between beam connectors may be defined herein as the distance from the center of one connector to the center of the adjacent connector along the beam connecting them (referred to herein as the "on-center" spacing). It is understood that the center axes of adjacent beam connectors are not parallel to one another and that on-center distance is dependent upon the location along the center axes at which the distance is measured. Comparison of on-center distances assumes a consistent standard.

With reference to FIGS. 12-18, the geodesic structure of the present invention may comprise exterior hexagonal panels 60 and exterior pentagonal panels 70. The hexagonal and pentagonal features of the geodesic structure may be referred to herein as "sides" of the structure. The structure may further comprise interior hexagonal panels 80 (FIG. 18) and interior pentagonal panels 90 (not shown). In a preferred embodiment, the panels comprise beveled edges so that the edges of adjacent panels may form a flush joint when assembled in a geodesic structure. The dihedral angle formed by the top surface and edge of the hexagonal panel may be about 69.09° and the dihedral angle formed by the top surface and edge of the pentagonal panel may be about 73.53°.

Panels 60, 70, 80 and 90 may comprise fastener holes for accepting fasteners for fastening the panels to beam connectors and/or beams.

The space between interior and exterior panels in geodesic structures of the present invention may accept studs, insulation, plumbing, wiring, HVAC and other things.

The legs of the beam connector may be widened as necessary to provide a broader seating surfaces 11, 12, 21, 22, 31 and 33 for the panels to accommodate location of panel fasteners further away from the panel edges. Additionally or in the alternative, in order to provide broader seating surface and accommodate more widely spaced panel fastener locations, beam connectors may be provided with flanges extending laterally outward from each leg along the slope of the respective top surfaces 11, 12, 21, 22, 31 and 33.

Geodesic structures of the present invention may further comprise parallel studs spanning the hexagonal and pentagonal spaces between beams. Structures may further comprise horizontal floors and vertical walls of tradition construction in the interior of the sphere.

The expression of linear and angular dimensions herein to the second decimal place or otherwise do not imply or impose greater precision or tighter tolerances than are generally accepted with conventional manufacturing methods for structural frame components or generally accepted for framing in the construction trade. Clearances in the joints allowing for finite adjustment before tightening may be desirable for ease of assembly and may be required to accommodate typical dimensional variances in individual parts.

While the invention has been particularly shown and described with reference to certain embodiments, it will be understood by those skilled in the art that various changes in form and details may be made to the invention without departing from the spirit and scope of the invention as described in the following claims.

I claim:

1. A beam connector comprising:

a middle portion;

a first leg extending radially outward from the middle portion at a downward longitudinal pitch of 11.64° from a horizontal plane;

a second leg extending radially outward from the middle portion at a downward longitudinal pitch of 11.64° from said horizontal plane; and a third leg extending radially outward from the middle portion at a downward longitudinal pitch of 11.64° from said horizontal plane;

wherein:

the second leg is disposed at a 124.31° angle counterclockwise from the first leg;

the third leg is disposed at a 111.38° angle counterclockwise from the second leg; and the first leg is disposed at a 124.31° angle counterclockwise from the third leg;

wherein:

the first leg comprises an upper portion configured to receive at least one object forming a dihedral angle of 138.19° along the longitudinal pitch of said first leg;

the second leg comprises an upper portion configured to receive at least one object forming a dihedral angle of 142.62° along the longitudinal pitch of said second leg; and the third leg comprises an upper portion configured to receive at least one object forming a dihedral angle of 142.62° along the longitudinal pitch of said third leg.

2. The beam connector of claim 1, wherein:

the first leg comprises a bottom portion adapted for receiving at least one object forming a dihedral angle of 138.19° along the longitudinal pitch line of said first leg;

the second leg comprises a bottom portion adapted for receiving at least one object forming a dihedral angle of 142.62° along the longitudinal pitch line of said second leg; and the third leg comprises a bottom portion adapted for receiving at least one object forming a dihedral angle of 142.62° along the longitudinal pitch line of said third leg.

3. The beam connector of claim 1 wherein:

a first top surface of the first leg is disposed in the same plane as a first top surface of the second leg;

a second top surface of the second leg is disposed in the same plane as a first top surface of the third leg; and a second top surface of the third leg is disposed in the same plane as a second top surface of the first leg.

4. The beam connector of claim 1 wherein:

a first top surface of the first leg is disposed at a downward slant outward to a side of the first leg facing counterclockwise, said slant being at an angle of about 69.09° from a first vertical reference plane, said first vertical reference plane being through a center reference axis of the beam connector and oriented at the same radial angle as the first leg;

a second top surface of the first leg is disposed at a downward slant outward to a side of the first leg facing clockwise, said slant being at an angle of about 69.09° from said first vertical reference plane;

a first top surface of the second leg is disposed at a downward slant outward to a side of the second leg facing clockwise, said slant being at an angle of about 69.09° from a second vertical reference plane, said second vertical reference plane being through the center reference axis of the beam connector and oriented at the same radial angle as the second leg;

a second top surface of the second leg is disposed at a downward slant outward to a side of the second leg facing counterclockwise, said slant being at an angle of about 73.53° from said second vertical reference plane;

a first top surface of the third leg is disposed at a downward slant outward to a side of the third leg facing clockwise, said slant being at an angle of about 73.53° from a third vertical reference plane, said third vertical reference plane being through the center reference axis of the beam connector and oriented at the same radial angle as the third leg; and a second top surface of the third leg is disposed at a downward slant outward to a side of the third leg facing clockwise, said slant being at an angle of about 69.09° from said third vertical reference plane.

5. The beam connector of claim 1 wherein at least one of said first, second and third legs comprises a cavity for receiving a beam.

6. The beam connector of claim 1 further comprising holes for receiving fasteners for fastening objects to at least one of said first, second and third legs.

7. The beam connector of claim 6 wherein the holes comprise holes for receiving fasteners for fastening objects to the upper portion of at least one of said first, second and third legs.

8. The beam connector of claim 6 wherein the holes comprise holes for receiving fasteners for fastening objects to the bottom portion of at least one of said first, second and third legs.

9. The beam connector of claim 6 wherein the holes comprise holes for receiving fasteners for fastening beams to at least one of said first, second and third legs.

10. The beam connector of claim 6 wherein the holes comprise holes for receiving fasteners for fastening objects to the upper portion of at least one of said first, second and third legs, holes for fastening objects to the bottom portion of at least one of said first, second and third legs, and holes for receiving fasteners for fastening beams to at least one of said first, second and third legs.

11. A beam connector comprising:

a middle portion;

a first leg extending radially outward from the middle portion at a downward longitudinal pitch of 11.64° from a horizontal plane;

a second leg extending radially outward from the middle portion at a downward longitudinal pitch of 11.64° from said horizontal plane; and a third leg extending radially outward from the middle portion at a downward longitudinal pitch of 11.64° from said horizontal plane;

wherein:

the second leg is disposed at a 124.31° angle counterclockwise from the first leg;

the third leg is disposed at a 111.38° angle counterclockwise from the second leg; and the first leg is disposed at a 124.31° angle counterclockwise from the third leg;

and wherein at least one of the first, second and third legs is adapted for connection to a beam disposed longitudinally along the pitch of the leg;

and wherein at least one of the first, second and third legs comprises a first planar surface and at least one other of the first, second and third legs comprises a second planar surface, said first and second planar surfaces being adapted to cooperatively support a flat panel.

12. An architectural structure comprising:

a plurality of beam connectors comprising:

a middle portion;

a first leg extending radially outward from the middle portion at a downward longitudinal pitch from a horizontal plane;

a second leg extending radially outward from the middle portion at a downward longitudinal pitch from said horizontal plane; and a third leg extending radially outward from the middle portion at a downward longitudinal pitch from said horizontal plane;

wherein:

the second leg is disposed at an angle counterclockwise from the first leg;

the third leg is disposed at an angle counterclockwise from the second leg; and the first leg is disposed at an angle counterclockwise from the third leg;

wherein at least one of the first, second and third legs comprises a first planar surface and at least one other of the first, second and third legs comprises a second planar surface, said first and second planar surfaces being adapted to cooperatively support a flat panel;

and a plurality of beams connected with the beam connectors in a pattern comprising at least one hexagon and at least one pentagon.

13. The architectural structure of claim 12 further comprising:

at least one panel having a perimeter shape conforming to at least a portion of a hexagon, said panel connected to at least one of the beam connectors; and at least one panel having a perimeter shape conforming to at least a portion of a pentagon, said panel connected to at least one of the beam connectors.

14. A beam connector for connecting beams in a geodesic structure, comprising:

a first member, a second member and a third member, each of said members extending outwardly at a downward pitch and comprising a first top surface, a second top surface oriented at an angle to the first top surface, at least one side surface oriented at an angle to at least one of the top surfaces, and at least one bottom surface oriented at an angle to the at least one side surface;

wherein:

the first member is disposed at an angle counterclockwise from the third member and clockwise from the second member;

the second member is disposed at an angle counterclockwise from the first member and clockwise from the third member; and the third member is disposed at an angle counterclockwise from the second member and clockwise from the first member; and wherein the first top surface of the first member and the first top surface of the second member form a support for supporting a flat hexagonal panel;

the second top surface of the second member and the first top surface of the third member form a support for supporting a flat pentagonal panel; and the second top surface of the third member and the second top surface of the first member form a support for supporting a flat hexagonal panel.

15. The beam connector of claim 14, wherein:

the bottom surface of the first member comprises a first and a second bottom surface;

the bottom surface of the second member comprises a first and a second bottom surface;

the bottom surface of the third member comprises a first and a second bottom surface;

the first bottom surface of the first member and the first bottom surface of the second member form a support for supporting a flat hexagonal panel;

the second bottom surface of the second member and the first bottom surface of the third member form a support for supporting a flat pentagonal panel; and the second bottom surface of the third member and the second bottom surface of the first member form a support for supporting a flat hexagonal panel.

16. A beam connector comprising:

a first leg extending in a direction outwardly from a vertical reference axis and at a downward longitudinal pitch;

a second leg extending in a direction outwardly from the vertical reference axis and at a downward longitudinal pitch and at an angle counterclockwise from the first leg; and a third leg extending in a direction outwardly from the vertical reference axis and at a downward longitudinal pitch and at an angle counterclockwise from the second leg and clockwise from the first leg;

wherein:

the first leg comprises an upper portion configured to receive at least one object forming a dihedral angle along the longitudinal pitch of said first leg;

the second leg comprises an upper portion configured to receive at least one object forming a dihedral angle along the longitudinal pitch of said second leg; and the third leg comprises an upper portion configured to receive at least one object forming a dihedral angle along the longitudinal pitch of said third leg.

17. The beam connector of claim 16, wherein:

the first leg further comprises a bottom portion adapted for receiving at least one object forming a dihedral angle along the longitudinal pitch line of said leg;

the second leg further comprises a bottom portion adapted for receiving at least one object forming a dihedral angle along the longitudinal pitch line of said leg; and the third leg further comprises a bottom portion adapted for receiving at least one object forming a dihedral angle along the longitudinal pitch line of said leg.

18. A beam connector comprising:

a first top surface oriented in a first top plane and second top surface oriented in a second top plane wherein said first and second top planes form a dihedral having a first top dihedral line oriented in a downward pitch and radially outward from a center axis;

a third top surface oriented in a third top plane wherein said second and third top planes form a dihedral having a second top dihedral line oriented in a downward pitch and radially outward from the center axis and at an angle counterclockwise about the center axis from the first top dihedral line; and wherein said third and first top planes form a dihedral having a third top dihedral line oriented in a downward pitch and radially outward from the center axis and at an angle counterclockwise about the center axis from the second top dihedral line;

wherein the beam connector is adapted for receiving an elongated beam disposed parallel to one of the first, second and third top dihedral lines.

19. The beam connector of claim 18, wherein the beam connector is adapted for receiving another elongated beam disposed parallel to another of the first, second and third dihedral lines.

20. The beam connector of claim 18, further comprising:

a first bottom surface oriented in a first bottom plane and second bottom surface oriented in a second bottom plane wherein said first and second bottom planes form a dihedral having a first bottom dihedral line oriented in a downward pitch and radially outward from a center axis;

a third bottom surface oriented in a third bottom plane wherein said second and third bottom planes form a dihedral having a second bottom dihedral line oriented in a downward pitch and radially outward from the center axis and at an angle counterclockwise about the center axis from the first bottom dihedral line; and wherein said third and first bottom planes form a dihedral having a third bottom dihedral line oriented in a downward pitch and radially outward from the center axis and at an angle counterclockwise about the center axis from the second bottom dihedral line, wherein the first bottom plane is parallel to the first top plane, the second bottom plane is parallel to the second top plane, and the third bottom plane is parallel to the third top plane.

* * * * *